US007409758B2

(12) United States Patent
Le et al.

(10) Patent No.: US 7,409,758 B2
(45) Date of Patent: Aug. 12, 2008

(54) VIBRATION DAMPER SYSTEMS FOR DRILLING WITH CASING

(75) Inventors: Tuong Thanh Le, Katy, TX (US); Richard L. Giroux, Cypress, TX (US); Albert C. Odell, Kingwood, TX (US); Gary Thompson, Katy, TX (US); Deborah L. Banta, Houston, TX (US); Robert P. Badrak, Sugar Land, TX (US); Gregory G. Galloway, Conroe, TX (US); Mark S. Fuller, Montgomery, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 615 days.

(21) Appl. No.: 10/977,481

(22) Filed: Oct. 29, 2004

(65) Prior Publication Data

US 2005/0092527 A1 May 5, 2005

Related U.S. Application Data

(60) Provisional application No. 60/515,391, filed on Oct. 29, 2003.

(51) Int. Cl.

| | |
|---|---|
| ***B23P 17/00*** | (2006.01) |
| ***B21D 39/08*** | (2006.01) |
| ***E21B 17/00*** | (2006.01) |
| ***E21B 17/10*** | (2006.01) |

(52) U.S. Cl. ..... 29/421.1; 72/58; 72/61; 166/241.7; 166/212; 175/325.6; 175/325.5

(58) Field of Classification Search ..... 175/325.6, 175/325.5; 29/421.1; 166/241.7, 212; 72/58–62
See application file for complete search history.

(56) References Cited

U.S. PATENT DOCUMENTS

| | | | | |
|---|---|---|---|---|
| 2,696,367 | A | 12/1954 | Robishaw | |
| 3,320,004 | A * | 5/1967 | Garrett | 175/325.5 |
| 3,774,731 | A | 11/1973 | Zerb | |
| 4,398,772 | A * | 8/1983 | Odell | 175/325.6 |

(Continued)

FOREIGN PATENT DOCUMENTS

| | | |
|---|---|---|
| EP | 0 410 729 | 1/1991 |

(Continued)

OTHER PUBLICATIONS

Combine Search and Examination Report, Application No. 0623115.3, Dated Feb. 2, 2007.

(Continued)

*Primary Examiner*—David P. Bryant
*Assistant Examiner*—Alexander P Taousakis
(74) *Attorney, Agent, or Firm*—Patterson & Sheridan, L.L.P.

(57) ABSTRACT

Apparatus and methods are provided for reducing drilling vibration during drilling with casing. In one embodiment, an apparatus for reducing vibration of a rotating casing includes a tubular body disposed concentrically around the casing, wherein tubular body is movable relative to the casing. Preferably, a portion of the tubular body comprises a friction reducing material. In operation, the tubular body comes into contact with the existing casing or the wellbore instead of the rotating casing. Because the tubular body is freely movable relative to the rotating casing, the rotating casing may continuously rotate even though the tubular body is frictionally in contact with the existing casing.

14 Claims, 15 Drawing Sheets

U.S. PATENT DOCUMENTS

| | | | | |
|---|---|---|---|---|
| 4,938,299 | A | 7/1990 | Jelsma | |
| 5,069,297 | A | 12/1991 | Krueger | |
| 5,492,174 | A | 2/1996 | O'Hair | |
| 5,579,854 | A | 12/1996 | Barry | |
| 5,740,862 | A * | 4/1998 | Sable | 166/241.2 |
| 5,810,100 | A | 9/1998 | Samford | |
| 5,901,798 | A | 5/1999 | Herrera et al. | |
| 5,908,072 | A | 6/1999 | Hawkins | |
| 5,937,948 | A | 8/1999 | Robbins, III | |
| 6,006,830 | A | 12/1999 | Barron et al. | |
| 6,378,633 | B1 | 4/2002 | Moore et al. | |
| 6,435,274 | B1 | 8/2002 | Weislogel | |
| 6,513,233 | B1 | 2/2003 | Nakao et al. | |
| 6,666,267 | B1 | 12/2003 | Charlton | |
| 6,845,816 | B2 * | 1/2005 | Kirk et al. | 166/214.6 |
| 7,147,068 | B2 | 12/2006 | Vail, III | |
| 7,159,668 | B2 | 1/2007 | Herrera | |
| 7,165,634 | B2 | 1/2007 | Vail, III | |
| 2003/0106719 | A1 * | 6/2003 | Herrera | 175/325.2 |
| 2006/0231250 | A1 * | 10/2006 | Slack | 166/241.6 |

FOREIGN PATENT DOCUMENTS

| | | |
|---|---|---|
| GB | 733596 | 7/1955 |
| GB | 2338970 | 1/2000 |
| GB | 2358418 | 7/2001 |
| GB | 2 385 342 | 8/2003 |
| GB | 2385342 | 8/2003 |
| WO | WO 98/46382 | 10/1998 |
| WO | WO 99/25949 | 5/1999 |
| WO | WO 00/40833 | 7/2000 |
| WO | WO 01/59249 | 8/2001 |
| WO | WO 02/031312 | 4/2004 |
| WO | WO 2004/027207 | 4/2004 |

OTHER PUBLICATIONS

Collin J. Mason, Larry G. Williams, and Geoff N. Murray, Reducing Friction In High-Angle Wells, Worlds Oil, Nov. 2000, pp.1-5.

Norwegian Office Action, Patent Application No. 2004 4676, dated Jan. 8, 2007.

Search Report, Application No. 0424086.7, Dated Sep. 5, 2006.

U.K. Search Report Application No. GB0424086.7, dated May 27, 2005.

U.K. Search Report Application No. GB0424086.7, dated Feb. 18, 2005.

* cited by examiner

VIBRATION DAMPER SYSTEMS FOR DRILLING WITH CASING

CROSS-REFERENCE TO RELATED APPLICATIONS

This application claims benefit of co-pending U.S. Provisional Patent Application Ser. No. 60/515,391, filed on Oct. 29, 2003, which application is herein incorporated by reference in its entirety.

BACKGROUND OF THE INVENTION

1. Field of the Invention

Embodiments of the present invention generally relate to methods and apparatus for drilling with casing. Particularly, the present invention relates to methods and apparatus for reducing drilling vibration while drilling with casing. Additionally, the present invention relates to apparatus and methods for manufacturing a vibration damper.

2. Description of the Related Art

In the drilling of oil and gas wells, a wellbore is formed in a formation using a drill bit that is urged downwardly at a lower end of a drill string. To drill within the wellbore to a target depth, the drill string is often rotated by a top drive or rotary table on a surface platform or rig, or by a downhole motor mounted towards the lower end of the drill string. After drilling a predetermined depth, the drill string and the drill bit are removed, and the wellbore is lined with a string of metal pipe called casing. The casing string liner is temporarily hung from the surface of the well.

The casing provides support to the wellbore and facilitates the isolation of certain areas of the wellbore adjacent hydrocarbon bearing formations. The casing typically extends down the wellbore from the surface to a designated depth. An annular area is thus formed between the string of casing and the formation. A cementing operation is then conducted in order to fill the annular area with cement. Using apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, one conventional method of completing a well includes drilling to a first designated depth with a drill bit on a drill string. Then, the drill string is removed and a first string of casing is run into the wellbore and set in the drilled out portion of the wellbore. Cement is circulated into the annulus behind the casing string and allowed to cure. Next, the well is drilled to a second designated depth, and a second string of casing, or liner, is run into the drilled out portion of the wellbore. The second string is set at a depth such that the upper portion of the second string of casing overlaps the lower portion of the first string of casing. The second string is then fixed, or "hung" off of the existing casing by the use of slips which utilize slip members and cones to wedgingly fix the second string of casing in the wellbore. The second casing string is then cemented. This process is typically repeated with additional casing strings until the well has been drilled to a desired depth. Therefore, two run-ins into the wellbore are required per casing string to set the casing into the wellbore.

Because of the two run-in requirement, the traditional method of using the drillstring (pipe with drill bit on bottom) to form a wellbore is time consuming and expensive. The time required to remove the drilling string as the wellbore is extended results in an increase of operational time and costs. For example, an offshore drilling platform may rent for hundreds of thousands of dollars a day. Accordingly, reducing drilling time by even an hour may significantly reduce drilling costs.

Another method for performing well completion operations involves drilling with casing. In contrast to drilling with drill pipe and then setting the casing, drilling with casing entails running a casing string into the wellbore with a drill bit attached. The drill bit is operated by rotation of the casing string from the surface of the wellbore. Once the borehole is formed, the attached casing string is cemented in the borehole. The subsequent borehole may be drilled by a second casing having a second drill bit at a lower end thereof. The second casing string may be operated to drill through the drill bit of the previous casing string. In this respect, this method requires only one run-in into the wellbore per casing string that is set into the wellbore.

While drilling with casing provides an efficient system for wellbore completion, the system does have its drawbacks. For example, drilling with casing is sometimes more prone to drilling vibrations than the conventional drill pipe string. Excessive drilling vibration is a cause of premature failure or wear of drilling components and drilling inefficiency. Two common forms of drilling vibration include backwards whirl and stick slip vibration. Backwards whirl occurs due to lateral vibrations caused by the drillstring eccentricity, which may lead to centripetal forces during rotation. Stick slip vibration occurs due to torsional vibrations caused by nonlinear interaction between the drillstring and borehole wall. Slip stick vibration is characterized by alternating stops and intervals of large angular velocity.

Drilling vibration may occur more frequently in drilling with casing than conventional drilling. This is because drilling casing has a larger outer diameter than drill pipes. As a result of the smaller clearance, the potential for interaction between the drilling casing and the existing set casing is increased. As the drilling casing is rotated to the right, it can backwards whirl to the left along the ID of the set casing. The resultant centripetal forces are very high. This centripetal force can sometimes cause galling between the drilling-casing couplings and the set casing ID. The end result is an increase in drilling vibration and torque, sometimes to unacceptable levels.

Therefore, there is a need for apparatus and methods to reduce drilling vibration while drilling with casing. There is a further need for apparatus and methods to reduce friction between a drilling casing and an existing casing.

SUMMARY OF THE INVENTION

Embodiments of the present invention generally provide apparatus and methods for reducing drilling vibration during drilling with casing. In one embodiment, an apparatus for reducing vibration of a rotating casing includes a tubular body disposed concentrically around the casing, wherein tubular body is movable relative to the casing. Preferably, a portion of the tubular body comprises a friction reducing material. In operation, the tubular body comes into contact with the existing casing or the wellbore instead of the rotating casing. Because the tubular body is freely movable relative to the rotating casing, the rotating casing may continuously rotate even though the tubular body is frictionally in contact with the existing casing.

In another embodiment, the apparatus may optionally include at least one stop member for limiting axial movement of the tubular body. The apparatus may also include at least one contact member such as a blade. The friction reducing material may be selected from the group consisting of plastics, rubbers, elastomers, polymers, metals, and combinations thereof.

In another embodiment, a drilling system for forming a wellbore is provided. The drilling system comprises a tubular member; an earth removal member coupled to one end of the tubular member; and a centralizer disposed around the tubular member. Preferably, the centralizer includes a shell having a first hardness and a layer having a second hardness disposed on a contact surface of the shell.

In another embodiment, a method for forming a centralizer comprises providing a flat sheet of metal; forming a profile of a contact member on the flat sheet of metal; rolling the flat sheet of metal; and connecting two ends of the flat sheet of metal.

In another embodiment, the apparatus for reducing vibration of a rotating casing includes a tubular body disposed concentrically around the casing, wherein tubular body movable relative to the casing; and a coating of friction reducing material disposed on a contact surface of the tubular body. In another embodiment, the coating is disposed on at least a portion of an inner surface of the tubular body. In yet another embodiment, the coating includes one or more recesses formed on the coating.

In another embodiment still, the apparatus for reducing vibration of a rotating casing comprises an inner tubular body disposed concentrically to the casing and an outer tubular body concentrically disposed around the inner tubular body, wherein the inner and outer bodies are movable relative to each other. The apparatus may further include one or more channels formed between the inner and outer bodies. The channels may be adapted to house a plurality of bearings to facilitate relative rotation of the two bodies. In another embodiment, lubricant may be disposed in the channels.

In another embodiment still, a method for reducing vibration of a rotating casing includes disposing a tubular body around the casing such that the tubular body is movable relative to the casing. During operation the tubular body frictionally engages the surrounding wall instead of the casing, thereby permitting the casing to rotate continuously.

In another embodiment still, an apparatus for forming a centralizer is provided. The apparatus includes a housing; a pressure chamber in the housing; and a collapsible core disposable in the pressure chamber, the collapsible core having a profile for the centralizer, wherein a pressure increase in the pressure chamber conforms the centralizer to the profile of the collapsible core. In another embodiment, the collapsible core comprises a plurality of core sections, wherein at least one core section is collapsible.

In another embodiment still, a method of forming a centralizer includes providing an apparatus having a housing; a pressure chamber; and a collapsible core disposable in the pressure chamber, the collapsible core having a profile for the centralizer. The method also includes placing a tubular sleeve over the collapsible core; increasing a pressure in the pressure chamber; conforming the tubular sleeve to the profile of the collapsible core; forming the centralizer; and collapsing the collapsible core.

BRIEF DESCRIPTION OF THE DRAWINGS

So that the manner in which the above recited features can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Methods and apparatus are provided for reducing the occurrence of drilling vibration when performing drilling with casing.

Figure 1:
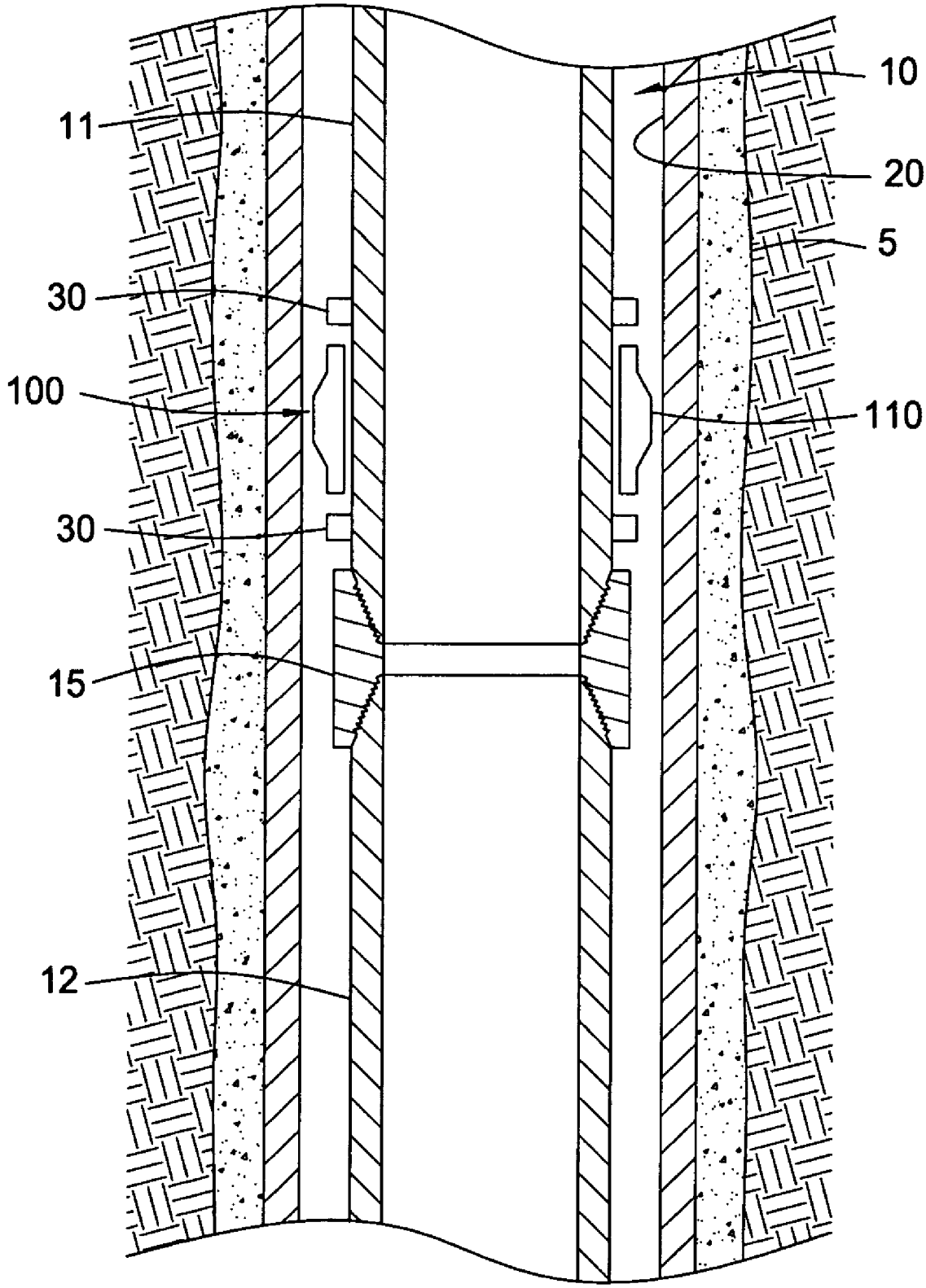
FIG. 1 is a partial view of drilling casing disposed in an existing casing. The drilling casing is shown with an embodiment of a centralizer.

FIG. 1 shows partial view of a drilling casing 10 disposed in an existing casing 20. The existing casing 20 has been cemented to line the wellbore 5. The drilling casing 10 is run into the wellbore 5 with a drilling assembly disposed at a lower portion to extend the wellbore 5. The drilling casing 10 is shown with two casing sections 11, 12 connected together by a coupling 15. Moreover, the coupling 15 has a larger outer diameter than the casing sections 11, 12. Therefore, the coupling 15 is more likely to contact the existing casing 20 than the casing sections 11, 12 during rotation.

In FIG. 1, the drilling casing 10 is equipped with a friction reducing tool 100 for minimizing drilling vibration. In one aspect, the friction reducing tool 100 is positioned on the drilling casing 10 between two stop collars 30. The collars 30 limit the axial movement of the friction reducing tool 100. Preferably, the collars 30 are disposed such that a suitable amount of axial movement by the friction reducing tool 100 is allowed. The collars 30 may be connected to the drilling casing 10 in any manner known to a person of ordinary skill in the art. In another embodiment, the coupling 15 may serve as a collar 30. It is further contemplated that the friction reducing tool may be used without any collars.

In one embodiment, the friction reducing tool 100 may comprise a tubular body 110 concentrically disposed on the drilling casing 10. The tubular body 110 may include an inner diameter that is slightly larger than the outer diameter of the casing section 11 forming the drilling casing 10. The larger diameter provides a clearance between the drilling casing 10 and the friction reducing tool 100 to allow for relative movement therebetween.

The friction reducing tool 100 may be adapted to contact the existing casing 20 instead of the drilling casing 10. Preferably, the outer diameter of the friction reducing tool 100 is larger than the outer diameter of the coupling 15. In this respect, the friction reducing tool 100 will encounter or contact the inner diameter of the existing casing 20 instead of the coupling 15, thereby limiting contact between the drilling casing 10 and the existing casing 20. During operation, encounters with the existing casing 20 may cause the friction reducing tool 100 to temporarily stick to the existing casing 20. However, due the clearance between the drilling casing 10 and the friction reducing tool 100, the drilling casing 10 may continuously rotate even though the friction reducing tool 100 is stuck to the existing casing 20. In this manner, drilling vibration caused by contact with the existing casing 20 may be minimized.

Figure 2A:
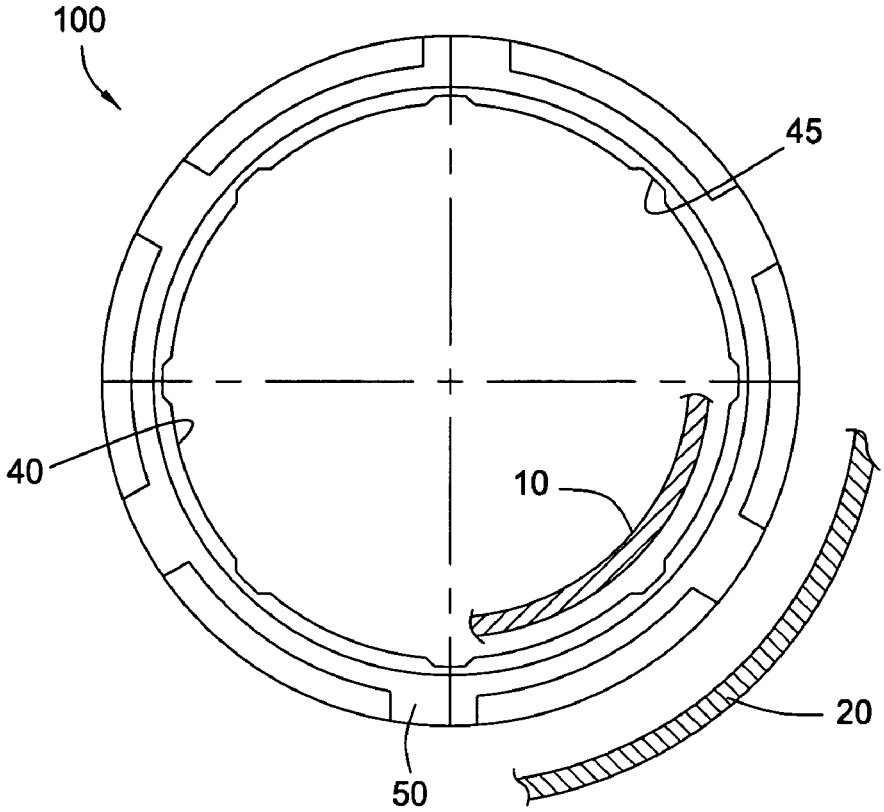
FIGS. 2A-B are different views of another embodiment of a centralizer.
Figure 2B:
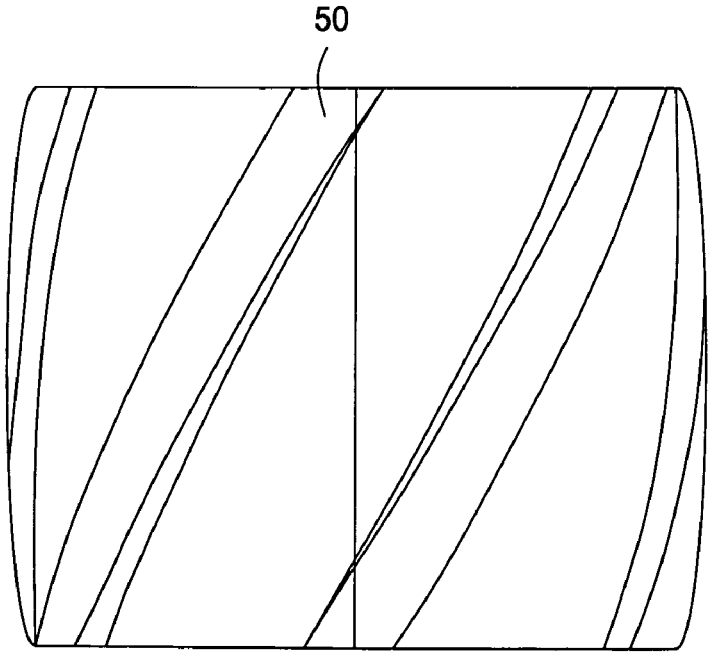

In another aspect, the friction reducing tool 100 may optionally include additional features for reducing friction between the drilling casing 10 and the existing casing 20. In the embodiment shown in FIGS. 2A-B, the contact surfaces of the friction reducing tool 100 may include a friction reducing material. For example, the inner surface and/or the outer surface of the friction reducing tool 100 may include a layer of friction reducing material. Suitable friction reducing materials include rubbers, elastomers, plastics, metals, polymers, other wear resistant material, other friction reducing material, or combinations thereof as is known to a person of ordinary skill in the art. The layer of friction reducing material may be disposed on the friction reducing tool 100 as a coating, a liner, or any other manner known to a person of ordinary skill in the art. In another embodiment, the layer of friction reducing material may be continuous or discontinuous. FIGS. 2A-B show a cross sectional view of the friction reducing tool 100 having a coating 40 of friction reducing material disposed on its inner surface. The coating 40 reduces the friction between the friction reducing tool 100 and the drilling casing 10, which, in turn, reduces drilling vibration. In another embodiment, recesses such as grooves, or flutes 45 may be formed on the coating 40 to further decrease friction between the friction reducing tool 100 and the drilling casing 10. The recesses may allow fluid or other material to pass through the friction reducing tool. In another embodiment still, the friction reducing tool 100 may be manufactured from metal, plastic, rubber, elastomers, or combinations thereof. In addition to being "slick", the selected coating material, in some instances, may also act as a sacrificial material to reduce wear on the casings 11, 12 or the friction reducing tool 100.

In another embodiment, contact members, such as blades 50, may be formed on the exterior of the friction reducing tool 100, as illustrated in FIGS. 2A-B. It is believed that the blades 50 provide a smaller overall contact area with the existing casing 20, thereby minimizing friction therebetween. The blades 50 may be arranged in any manner known to a person of ordinary skill in the art, for example, spiral or straight. The blades 50 advantageously allow fluid flow in the annular space between the casings 10, 20. The contact members may be manufactured from metal, plastic, rubber, elastomer, or combinations thereof. The contact members may be disposed on the outer surface by any manner known to a person of ordinary skill in the art, such as welding, mechanical attachment, molding, or combinations thereof. The contact members may also be formed integral to the friction reducing tool.

Figure 3A:
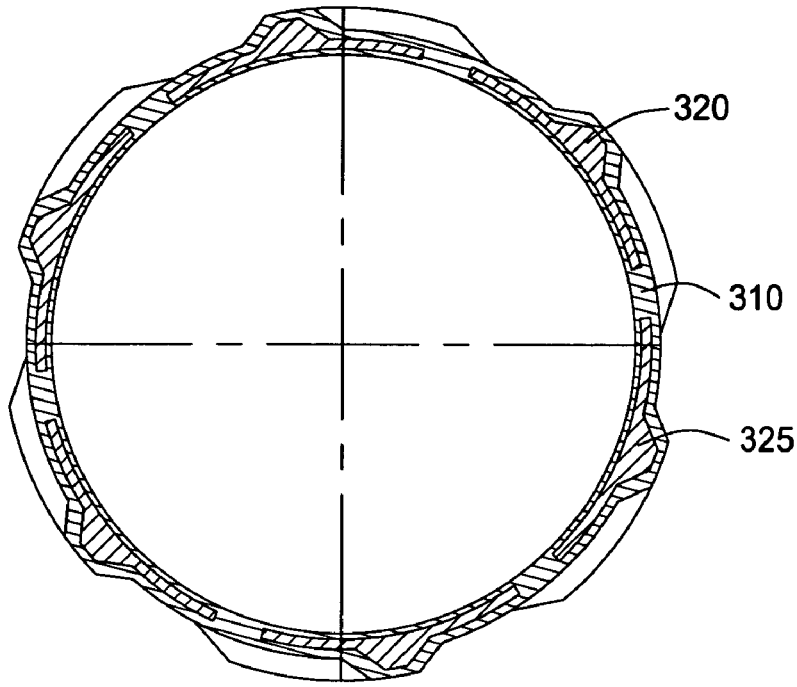
FIGS. 3A-B are different views of another embodiment of a centralizer.
Figure 3B:
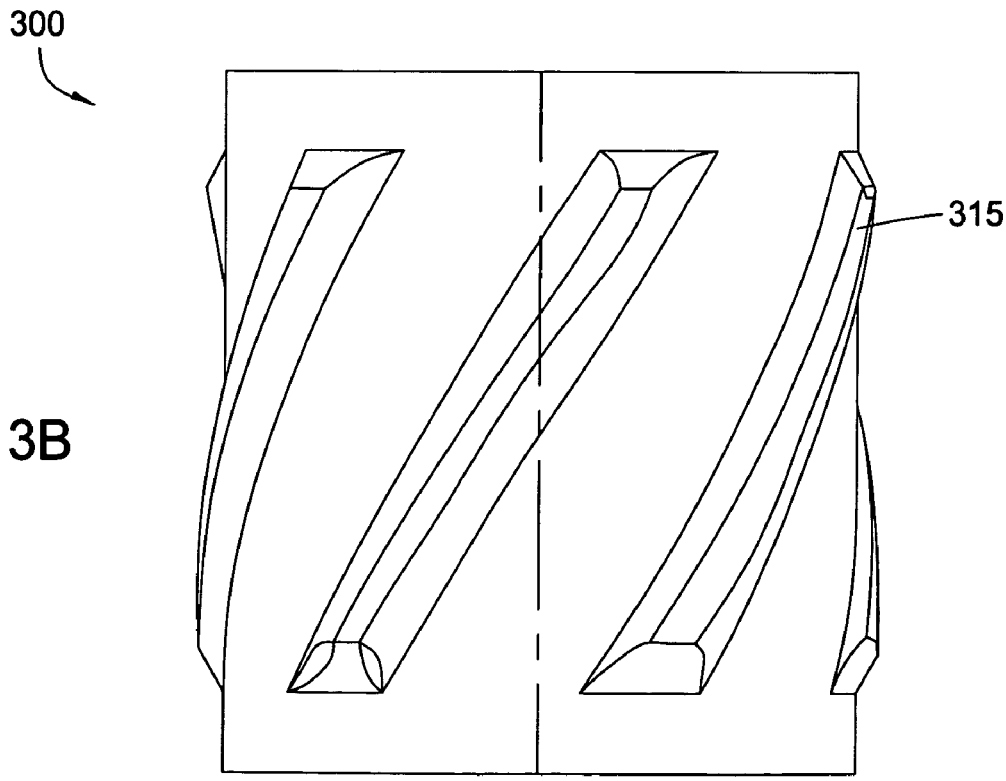

FIGS. 3A-B show another embodiment of a friction reducing tool. As shown, the friction reducing tool is a centralizer 300, also known as a stabilizer, having a body 310 formed of friction reducing material. Preferably, blades 315 are molded onto the body 310 to reduce friction. The body 310 is supported by a skeleton 320 formed of metal or other suitable supporting material. In one embodiment, the skeleton 320 comprises a plurality of arcuate shaped supports 325 radially disposed in the body 310. The body 310 or the blades 315 may be manufactured from a friction reducing material or wear resistant material. Suitable friction reducing and wear resistant materials include plastics, elastomers, rubbers, polymers, metals, or combinations thereof.

Figure 4:
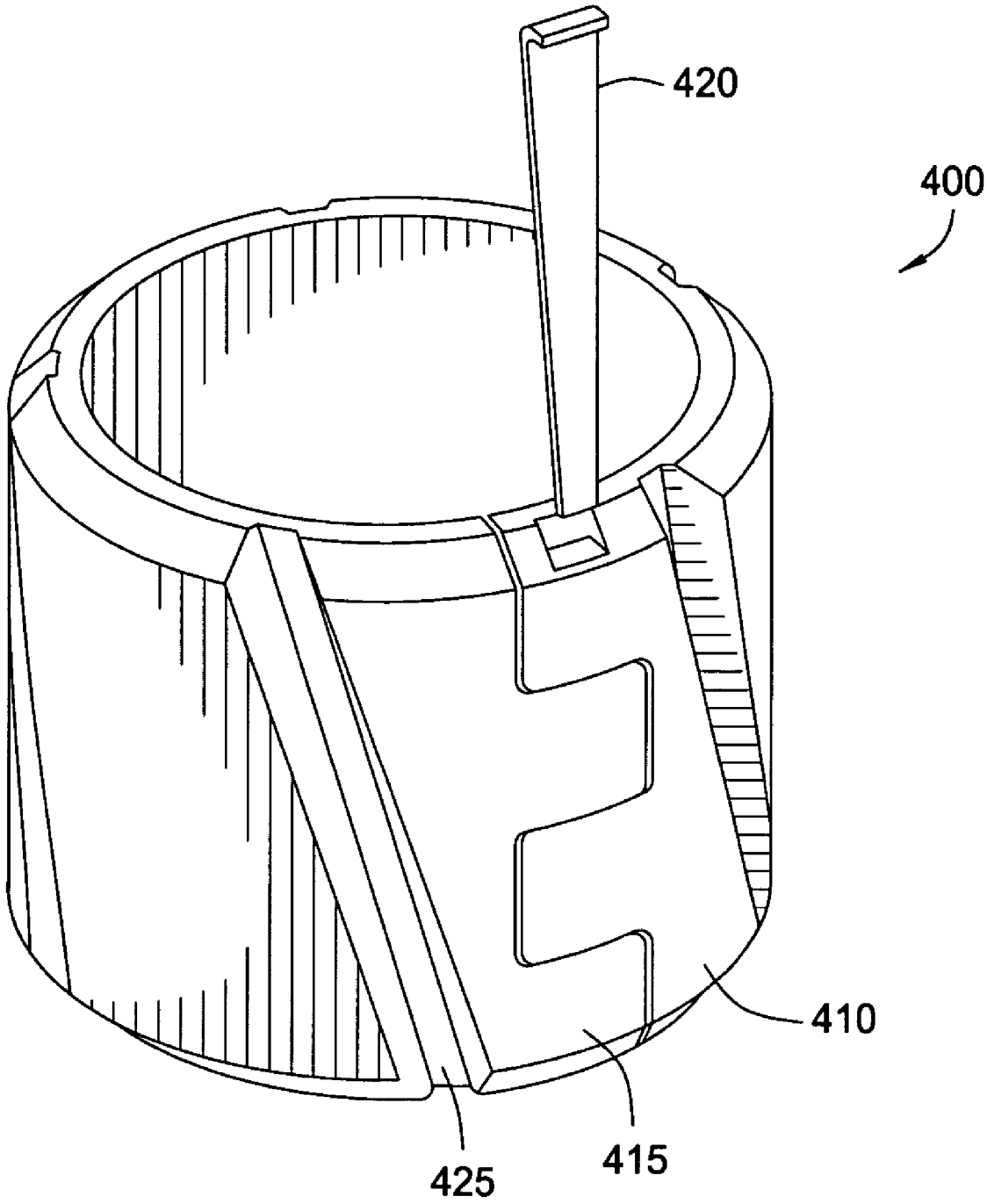
FIG. 4 depicts an embodiment of a casing protector.

In another aspect, the friction reducing tool may comprise a casing protector 400 as shown in FIG. 4. The casing protector 400 may be similarly disposed between two collars as the friction reducing tool shown in FIG. 1. In one embodiment, the casing protector 400 may include two body parts 410, 415 operatively coupled together to encircle a portion of the drilling casing 10. A latch 420 may be provided to prevent body parts 410, 415 from opening during operation. Preferably, the casing protector 400 includes one or more recesses 425 or flutes formed on the exterior surface of the casing protector 400. The casing protector 400 may be manufactured from any suitable material disclosed herein or known to a person of ordinary skill in the art.

In another aspect, the coupling 515 may be adapted to perform as a friction reducing tool. In one embodiment, the coupling 515 may be made from a material that is dissimilar to the existing casing 20. For example, the coupling 515 may be made of friction reducing alloy. It is believed that galling occurs to a lesser extent between dissimilar metals than similar metals. Therefore, the use of a coupling 515 made of a dissimilar metal or metal alloy may reduce galling between the coupling 515 and the existing casing 20 during operation. In another embodiment, the outer diameter of the coupling 515 may be coated with a slick material such as plastic and other material disclosed herein. The coating may be disposed on the coupling 15 in any manner known to a person of ordinary skill in the art, including molding, welding, thermal spraying, plating, and combinations thereof.

Figure 5:
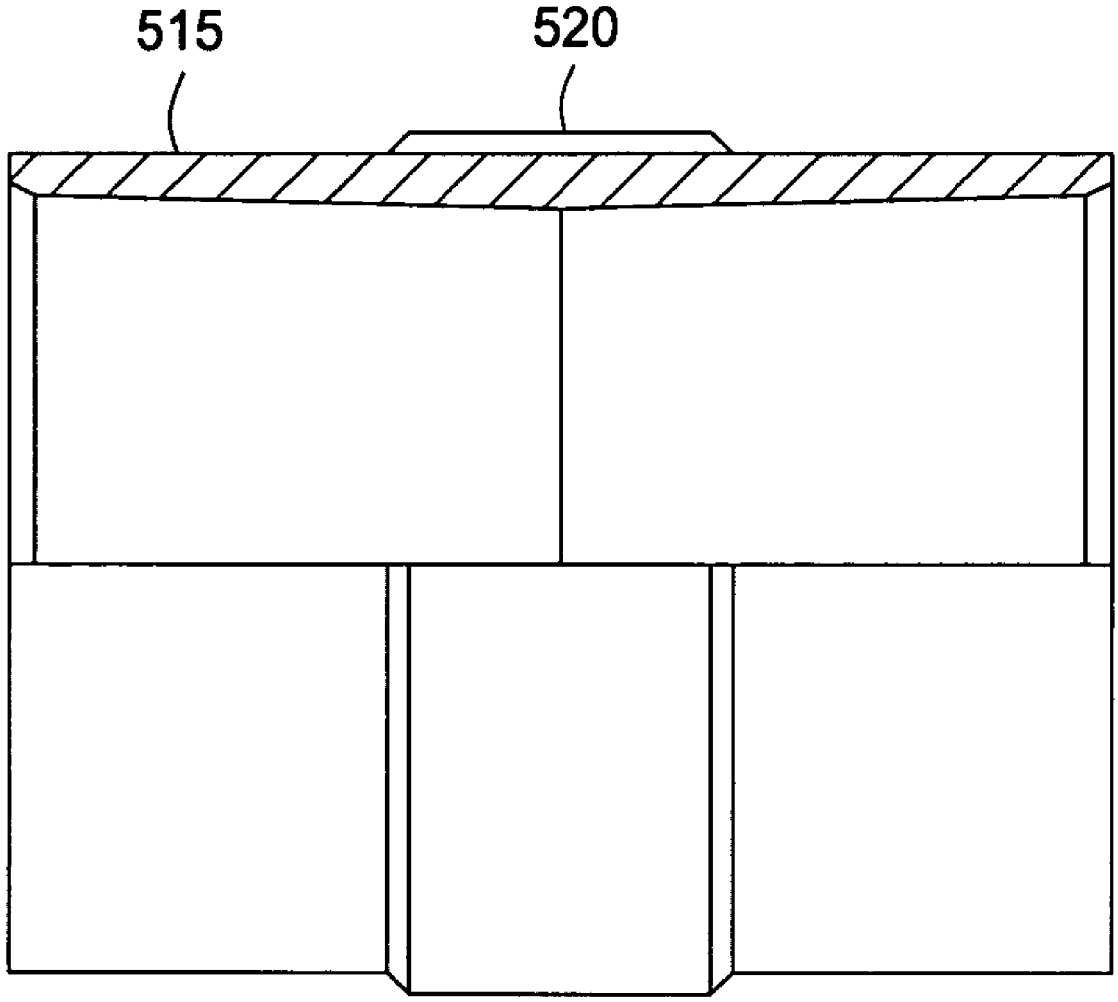
FIG. 5 is an embodiment of a coupling having a band of coating.

In another aspect still, a friction reducing material may be disposed on all or a portion of the coupling 515. In FIG. 5, a band 520 of friction reducing material is formed on the coupling 515. As shown, the band 520 has a larger outer diameter than the coupling 515, thereby allowing the band 520 to contact the existing casing 20 instead of the coupling 515. In this respect, the band 520 provides a smaller contact area and allows the coupling 515 to glide off the existing casing 20 after contact. Preferably, the friction reducing material is also wear resistant. In one embodiment, the band 520 comprises a dissimilar metal such as aluminum bronze, bronze alloy, copper alloy, hard facing, and combinations thereof. An example of hard facing include forming a matrix material comprising tungsten and a filler material such as nickel, cobalt, chromium, and combinations thereof. The band 520 may also be suitably made from plastic, rubber, elastomer, polymer, metal, and combinations thereof. The band 520 may be disposed on the coupling 515 using spray welding, plasma, laser cladding, shrink fitting, or combinations thereof. Although a single band 520 is shown, it must be noted that aspects of the present invention contemplates other types of patterns, for example, dual band, diagonal bands, intersecting bands, dot matrix, and combinations thereof.

Figure 6C:
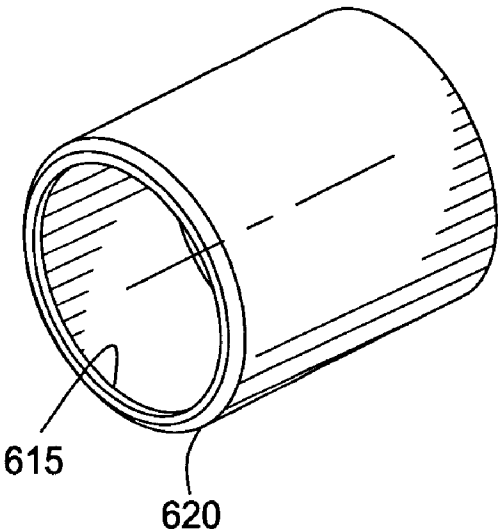
FIGS. 6A-C are different embodiments of a coupling coated with a friction reducing material.
Figure 6B:
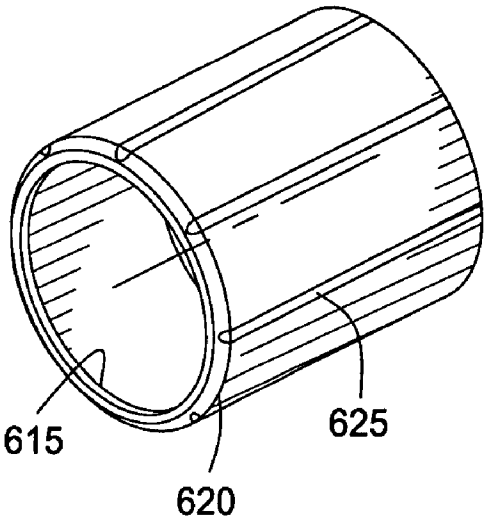
Figure 6A:
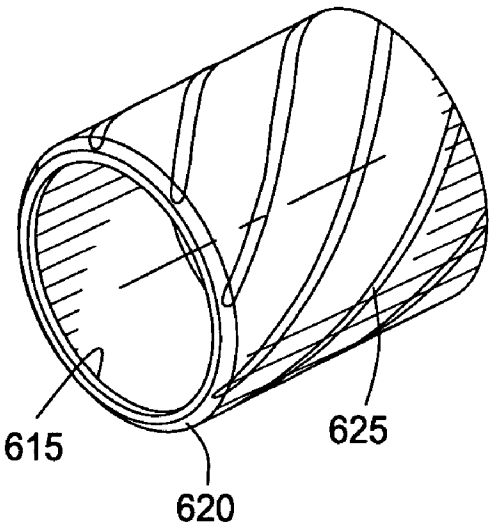

FIG. 6 shows another embodiment of a coupling 615 having a layer 620 of friction reducing material disposed on an outer surface. As shown, recesses or flutes 625 may be formed on the outer surface of the layer 620. FIGS. 6A and 6B depicts two different embodiments for patterning the flutes 625.

In another embodiment, contact members such as a blade or a ridge may be formed directly on the outer surface of the drilling casing 10. The blades may be circumferentially disposed on the drilling casing 10. In this respect, the blades may rotate with the casing during drilling. The blades may be attached to the drilling casing 10 using a bonding agent such as glue or welding, mechanical attachments such as set screws, or combinations thereof.

In another aspect, a water based drilling mud may be adapted to reduce the friction during drilling. In one embodiment, a lubricant may be added to increase the lubricity of the drilling mud. Any suitable lubricant may be used as is known to a person of ordinary skill in the art.

Figure 7:
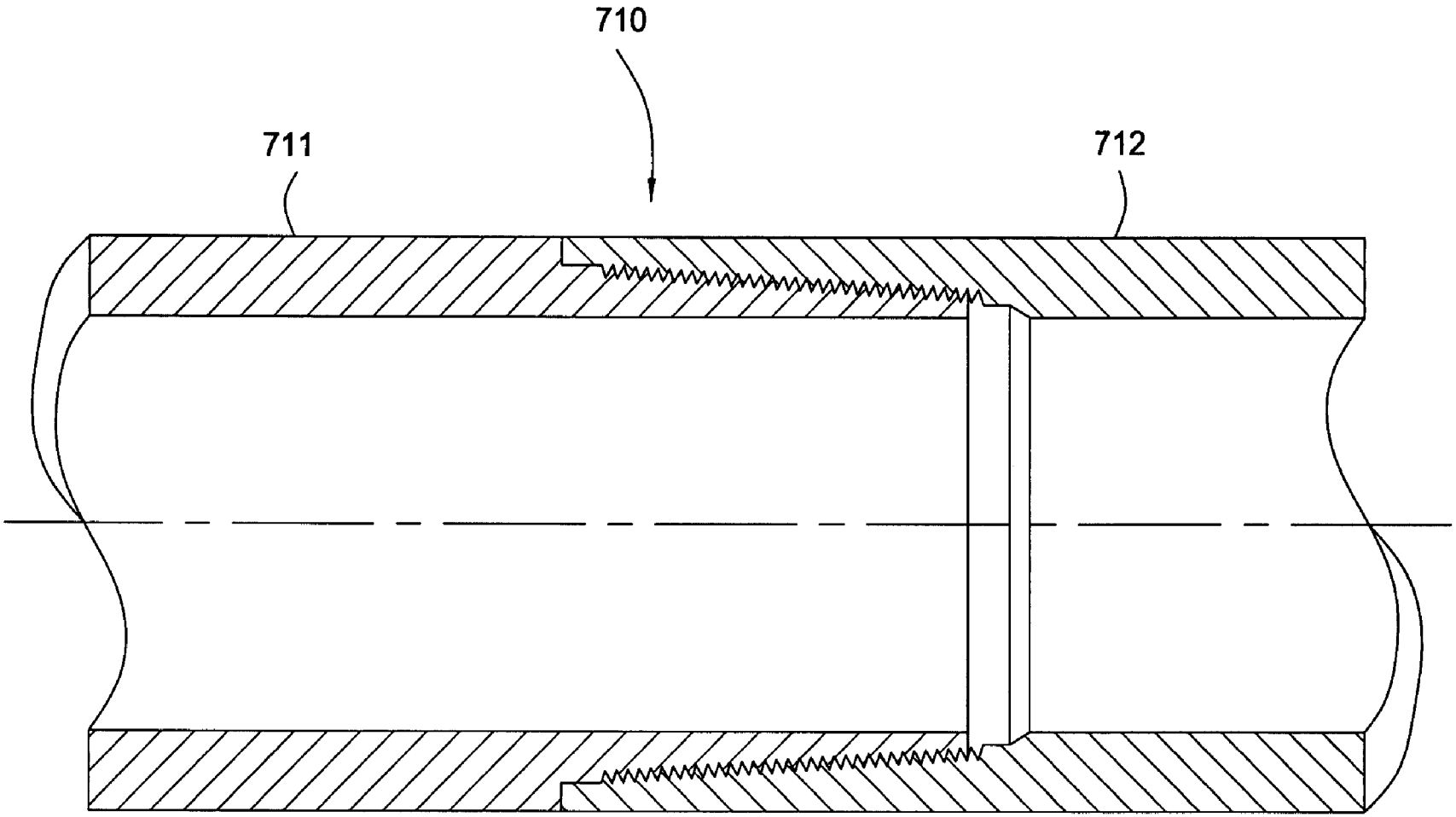
FIG. 7 is a partial view of a drilling casing made up a flush joint casing.

In another aspect, the drilling casing may be adapted to reduce drilling vibration. In one embodiment, the drilling casing 710 may be made up using casings 711, 712 having flush joints, as shown in FIG. 7. Preferably, the flush joint casings 711, 712 are added to the drilling casing portion proximate the bottom hole assembly. Drilling casing 710 made up of flush joint casings generally are heavier in weight. It is believe that the additional weight keeps the drilling casing 710 in tension during operation, thereby limiting eccentric rotation of the drilling casing 710. In another aspect, a drilling casing 710 made up of flush joint casings may include a thicker cross-sectional area. For example, the drilling casing 710 may have same outer diameter as a conventional coupling and the same inner diameter as a casing section connected by the coupling. It is believed that the thicker cross-sectional area results in a stiffer drilling casing 710, thereby limiting the tendency for eccentric rotation by the drilling casing 710. In this respect, a drilling casing 710 fitted with flush joint casings 711, 712 may experience a reduced amount of drilling vibration.

Figure 8B:
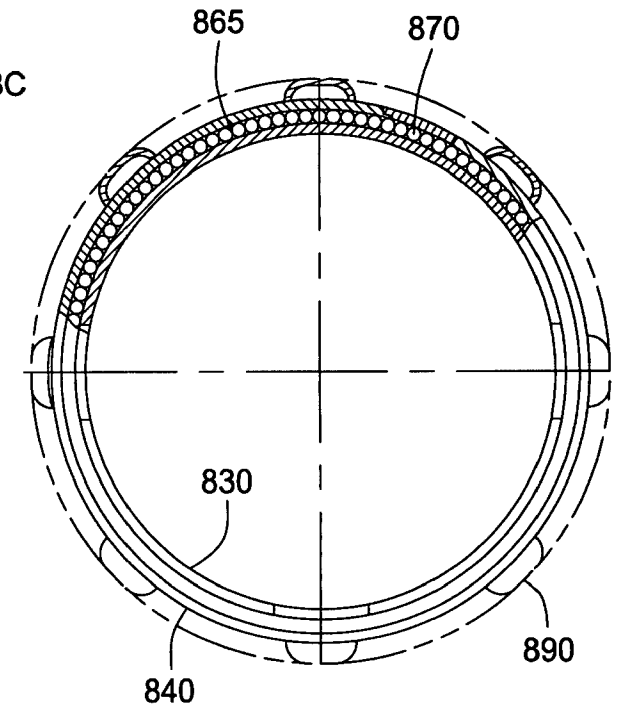
FIGS. 8A-C present different views of another embodiment of a centralizer.
Figure 8A:
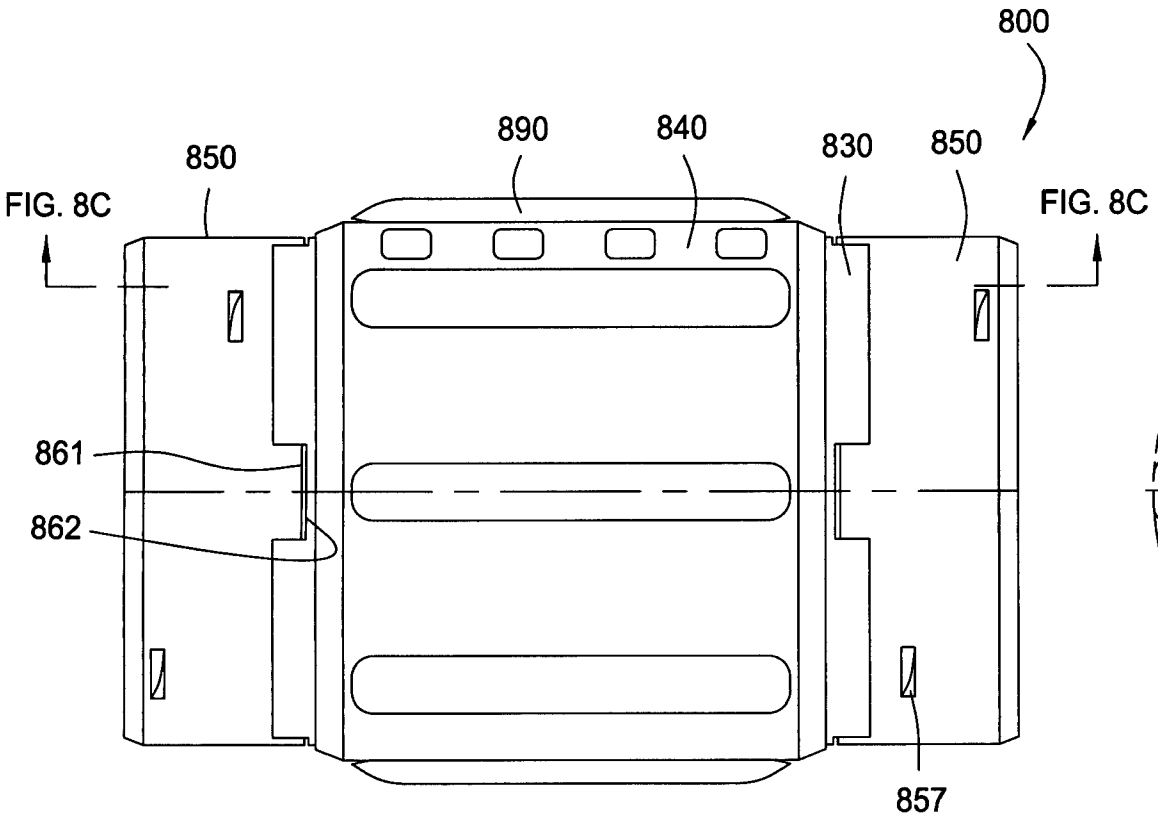
Figure 8C:
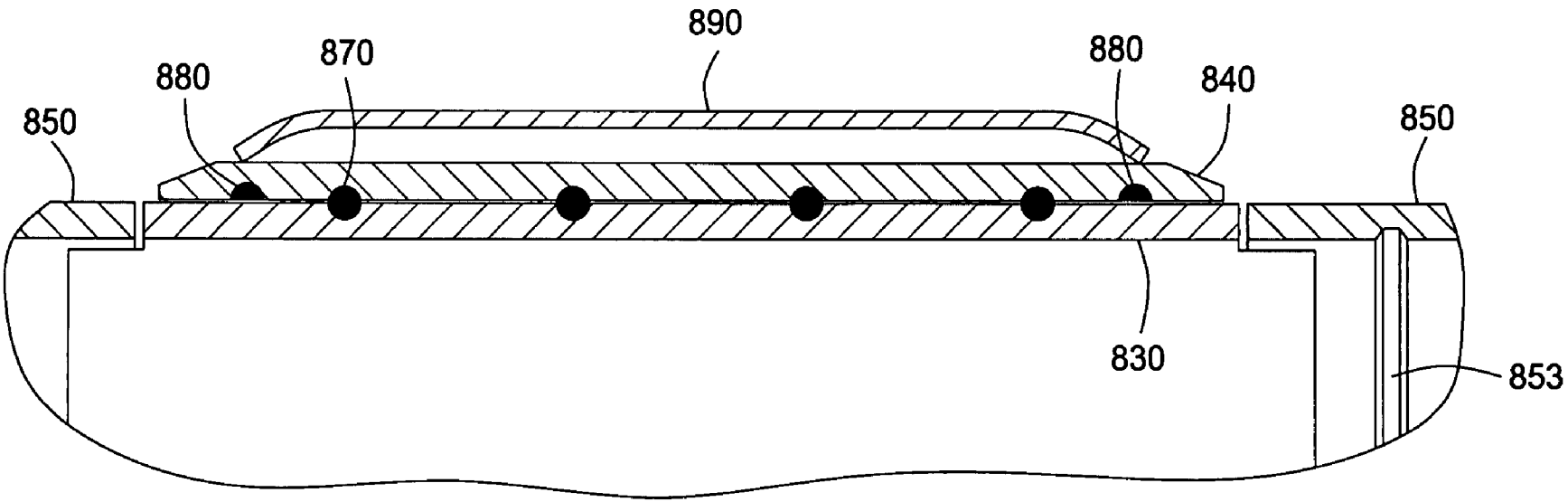

FIGS. 8A-C show a centralizer 800 applicable for minimizing drilling vibration while drilling with casing. FIG. 8A shows a perspective view of the centralizer. FIG. 8B shows a cross-sectional view of the centralizer. FIG. 8C show a partial cross-sectional view of the centralizer. The centralizer 800 may be disposed on the drilling casing 10 to minimize contact between the drilling casing 10 and the existing casing 20. In one embodiment, the centralizer 800 may include an inner tubular body 830 concentrically disposed within an outer tubular body 840. The outer body 840 may also include a collar 850 disposed at either end of the outer body 840. The collar 850 is adapted to attach the centralizer 800 to the drilling casing 10. As shown, a circumferential groove 853 is formed on the inner surface on the collars 850. A spiral nail 857 may be disposed in the groove 853 between the collar 850 and the drilling casing 10 to attach the centralizer 800 to the drilling casing 10. The inner body 830 is prevented from rotating relative to the collars 850 by a male and female type connection. Particularly, male protrusions 861 of the collar 850 may be received in the female recesses 862 of the inner body 830. In this manner, the inner body 830 is prevented from rotating relative to the collars 850 and the drilling casing 10.

In another aspect, the outer tubular body 840 is rotatable relative to the inner tubular body 830. As shown, one or more channels 865 for receiving ball bearings 870 are formed circumferentially between the inner body 830 and the outer body 840. Particularly, a portion of the channel 865 is formed in the inner body 830 and a mating portion is formed in the outer body 840. The channels 865 are adapted to receive a plurality of ball bearings 870. As shown, the centralizer 800 is provided with four rows of channels 865. In this respect, the ball bearings 870 may maintain the axial position of the outer body 840 relative to the inner body 830 and facilitate the rotation between the two bodies 830, 840. Optionally, the area between the two bodies 830, 840 and the channels 865 may be filled with grease 875 to facilitate relative movement therebetween. The grease 875 may be retained using two seals 880 optimally positioned to prevent leakage. In the preferred embodiment, the centralizer 800 is equipped with blades 890 or other types of contact members. The blades 890 may be disposed on the outer body 840 in any pattern disclosed herein or known to a person of ordinary skill in the art.

In operation, the centralizer 800 may be attached to the drilling casing 10 using the spiral nails 857. During operation, the outer body 840 of the centralizer 800 may come into contact with the existing casing 20. The encounter with the existing casing 20 may cause the outer body 840 to temporarily stick to the existing casing 20. However, because the inner body 830 is rotatable relative to the outer body 840, the drilling casing 10, which is coupled to the inner body 830, may continuously rotate even though the outer body 840 is stuck to the existing casing 20. In this manner, drilling vibration is minimized during drilling with casing.

In another aspect, a layer of friction reducing material may be disposed between the inner and outer tubular bodies 830, 840. The friction reducing material may be disposed on the inner body 830, the outer body 840, or both. In this respect, the tubular bodies 830, 840 may rotate relative to each other without the aid of the ball bearings 870. However, one of ordinary skill in the art will notice that stop collars may be required to limit the axial movement of the outer body 840.

Figure 13:
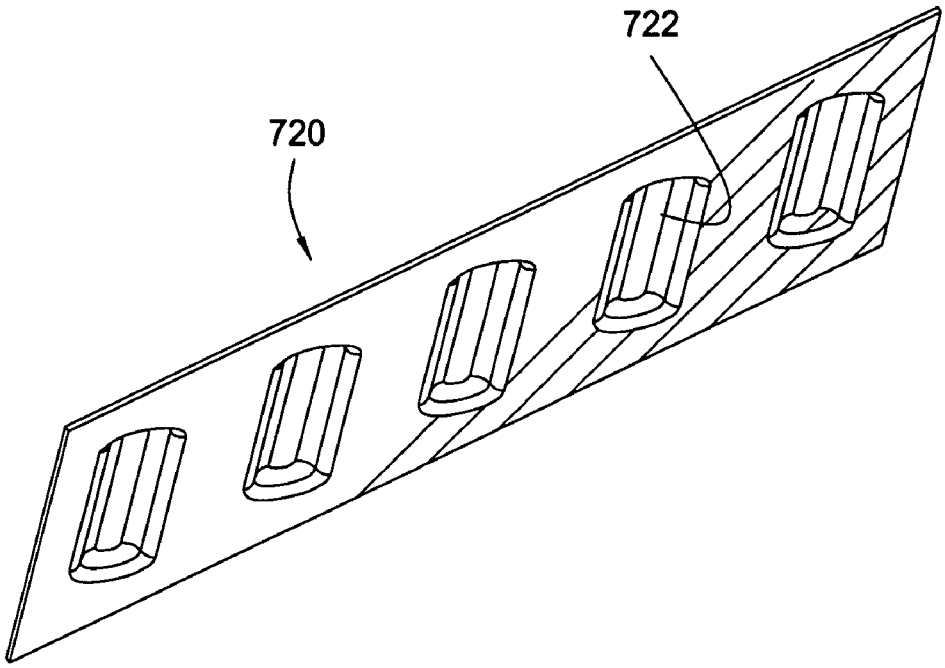
FIGS. 13 and 14 show another embodiment of forming a centralizer.
Figure 14:
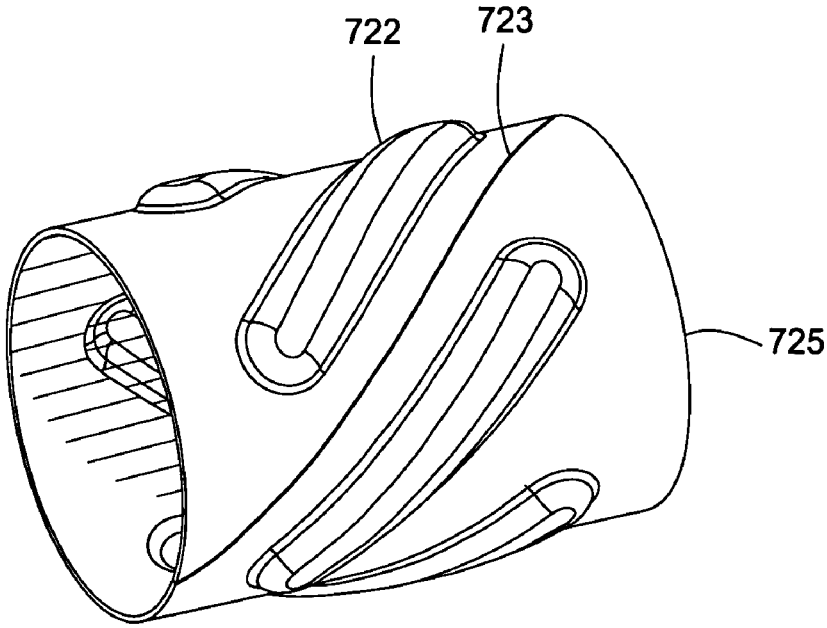

In another aspect, various processes are contemplated for manufacturing a centralizer. In one embodiment, a flat piece of stock material 720 such as metal may be hydro-formed with the desired profile of a contact member 722 such as a blade, as illustrated in FIG. 13. Thereafter, the flat stock material 720 is rolled over a cylindrical mandrel, and the roll seam 723 is welded to form a tubular shaped centralizer 725, as shown in FIG. 14. Other manufacturing processes such as foundry casting, hot stamping, forging, cold-work stamping, or combinations thereof may also be used to produce the centralizer. A liner may be disposed on the interior surface or exterior surface of the centralizer 725.

Figure 10:
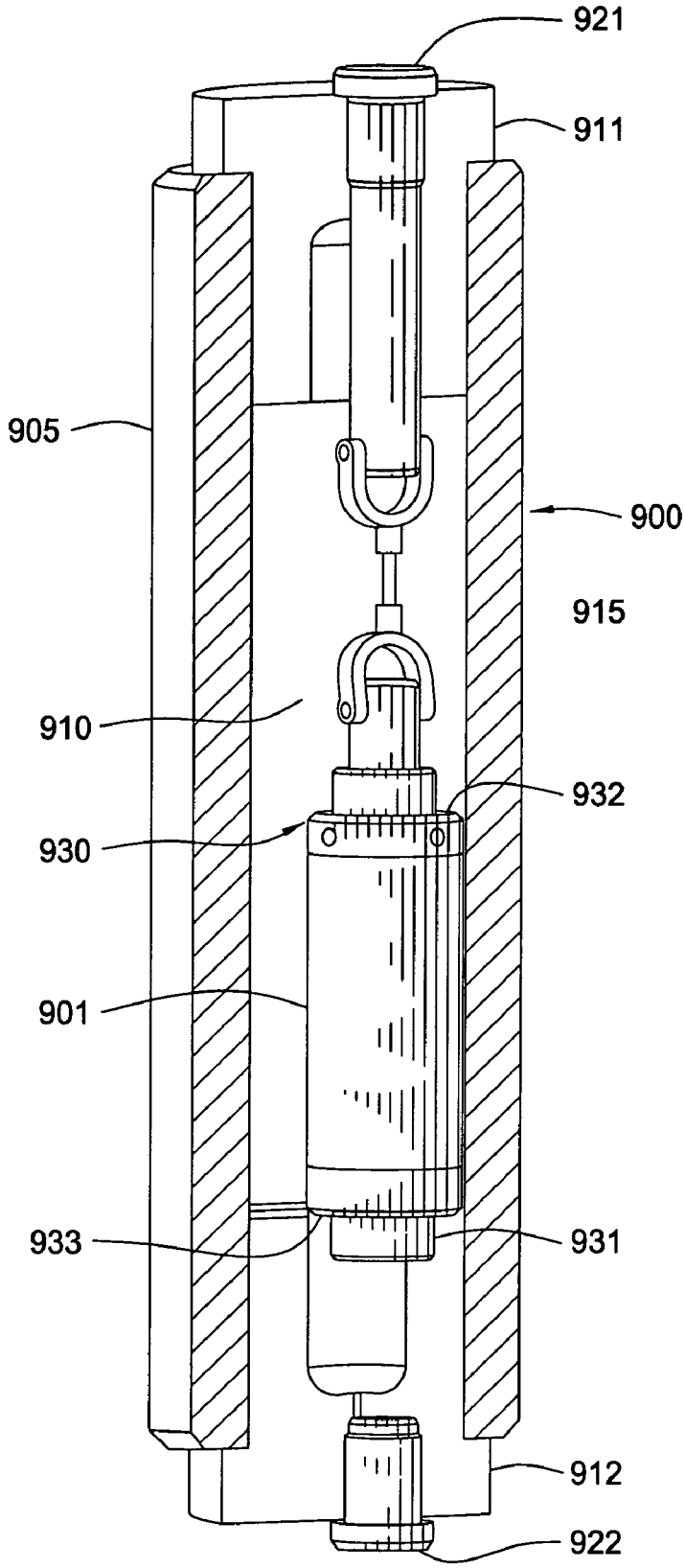
FIG. 10 shows an embodiment of an apparatus suitable for forming a centralizer.
Figure 11:
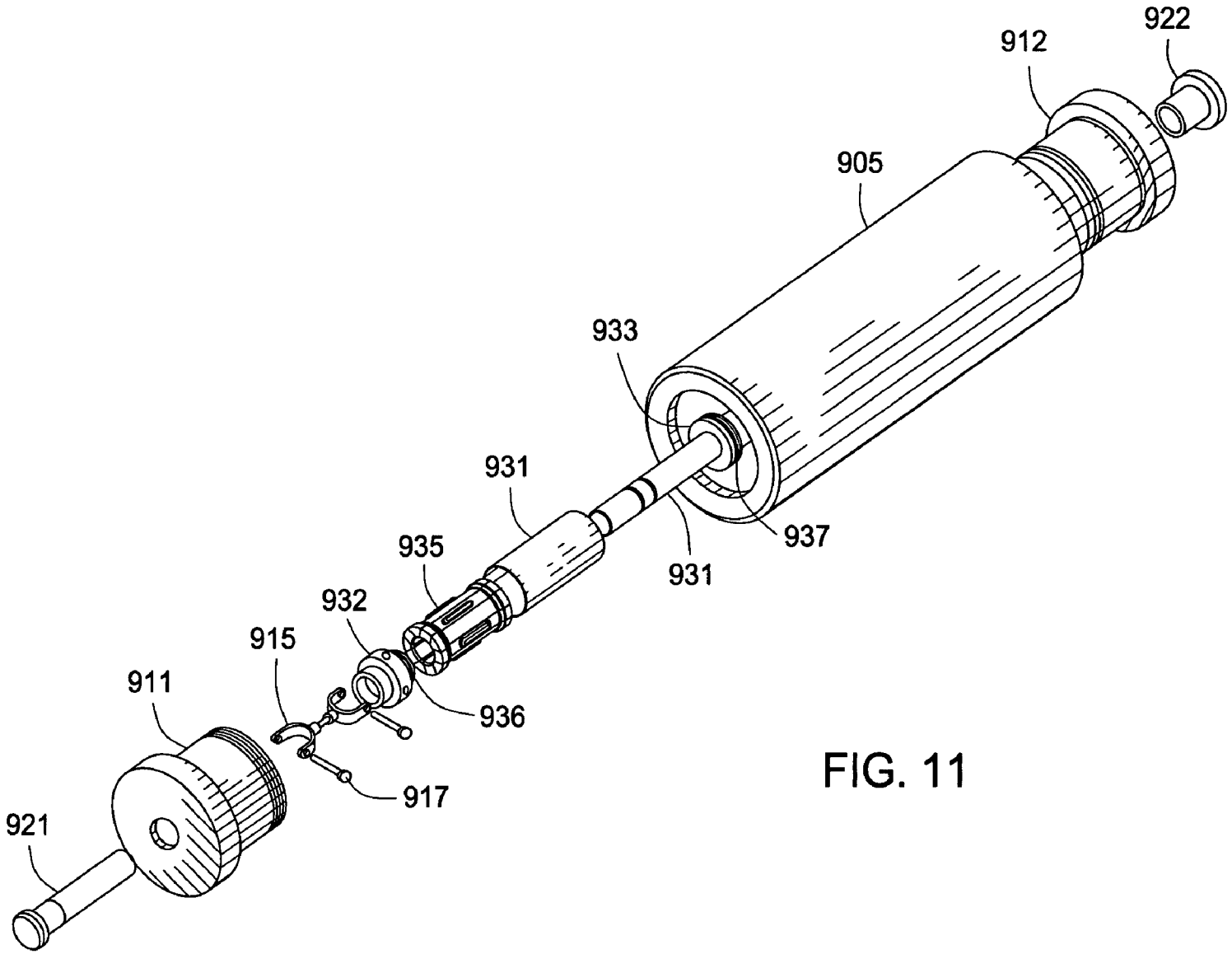
FIG. 11 is another perspective of the apparatus of FIG. 10.

In another embodiment, a centralizer may be manufactured by hydro-forming a tubular sleeve 901. FIGS. 10 and 11 show an embodiment of an apparatus 900 suitable for producing a centralizer using the hydro-forming process. The apparatus 900 includes a tubular housing 905, an upper cover member 911, and a lower cover member 912, which are adapted to seal off the housing 905, thereby defining a pressure chamber 910 inside the housing. Each of the upper and lower cover members 911, 912 are adapted to receive an injector cap 921, 922, respectively. In this respect, fluid pressure may be supplied to the pressure chamber 910 through one or both of the injector caps 921, 922.

The pressure chamber 910 is adapted to retain a core assembly 930 for forming the centralizer. In one embodiment, the core assembly 930 is coupled to the upper injector cap 921 using a hanger 915. The core assembly 930 comprises a mandrel 931 inserted through a collapsible core 935. A retainer 932, 933 is coupled to each end of the core 935 and the mandrel 931. In one embodiment, each of the retainers 932 933 is threadedly connected to the mandrel 931. The tubular sleeve 901 may be placed over the collapsible core 935 and partially overlapping a portion of each of the retainers 932, 933. Preferably, a sealing member 936, 937 such as an o-ring is disposed between the tubular sleeve 901 and the retainers 932, 933, thereby preventing fluid from entering into the tubular sleeve 901.

Figure 12:
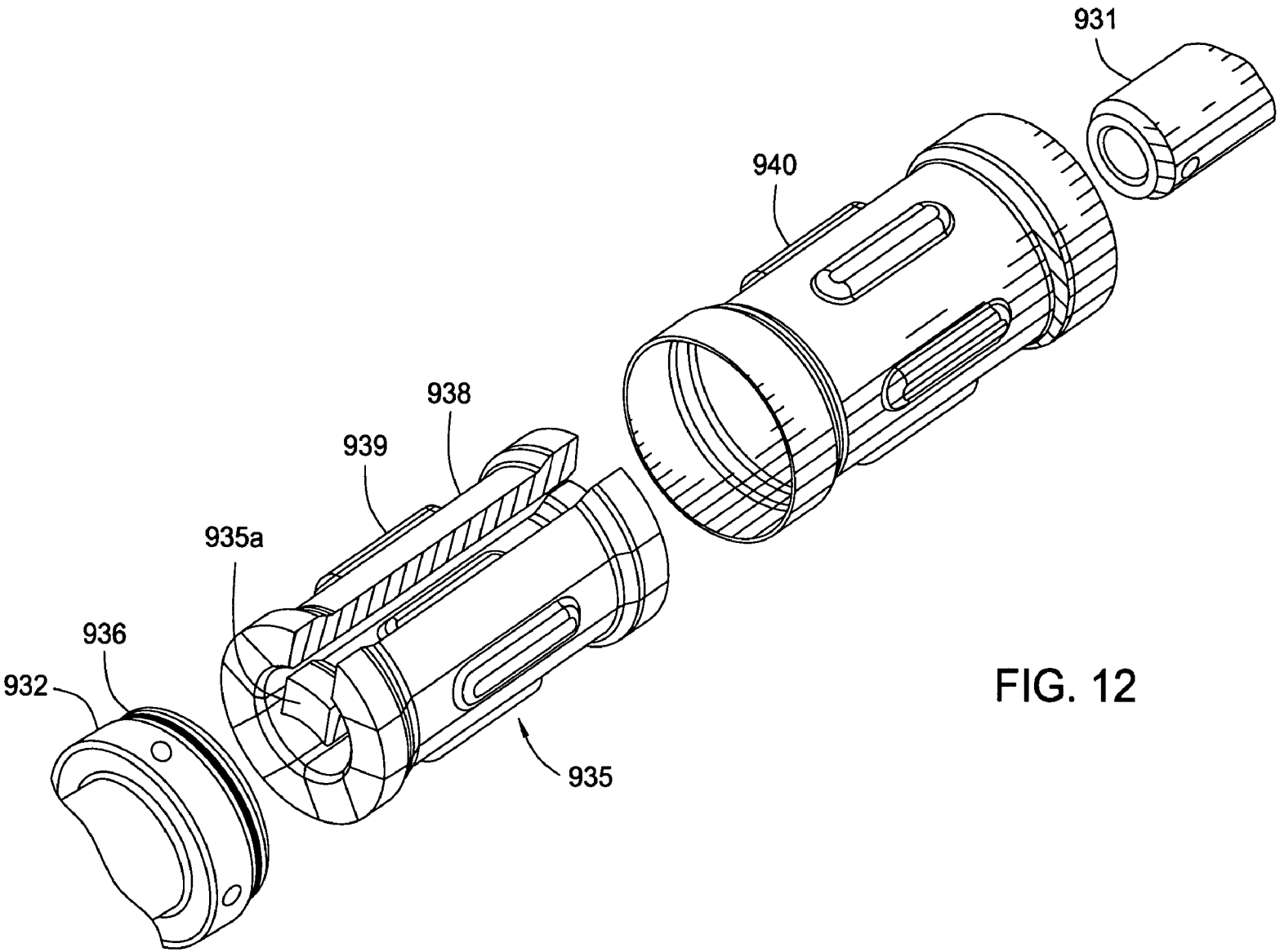
FIG. 12 is another perspective of the apparatus of FIG. 10.

An embodiment of the collapsible core 935 is shown in FIG. 12. The collapsible core 935 defines a tubular having an inner diameter adapted to receive the mandrel 931. The core 935 comprises a plurality of core sections that may be arranged around the mandrel 931. At least one of the core sections 935*a* is adapted to collapse from the core 935 when the mandrel 931 is removed from the core's center. As shown, the collapsible core 935 is made up of ten core sections. However, any number of core sections may be used so long as at least one section is collapsible from the core.

The exterior of the collapsible core 935 may include the profile 939 of the contact member of the centralizer 901. In one embodiment, the ends of the core 935 have an outer diameter that is about the same or smaller than the inner diameter of the tubular sleeve 901. The middle portion 938 of the core 935 is recessed, or has a smaller diameter than the ends of the core 935. The profile 939 of the contact member is "raised" or protrudes from the middle portion 938 of the core 935. The protruded portion 938 can be straight and parallel to the axis of the core 935, or form a helix angle relative to the axis of core 935. In this respect, the core 935 acts similar to a molding for forming the profile 938 of the contact member.

In operation, the collapsible core 935 is arranged around the mandrel 931. The tubular sleeve 901 is slid over the collapsible core 935 until it overlaps one retainer 933. Thereafter, the other retainer 932 is threadedly connected to the mandrel 931 to retain tubular sleeve 901 over the collapsible core 935 and seal off the inner portion of the tubular sleeve 901 from the pressure fluid. Retainer pins 917 are then used to couple the mandrel 931 to the hanger 915 and the hanger 915 to the injection cap 921. FIG. 10 shows the tubular sleeve 901 engaged to the core assembly 930 and retained in the pressure chamber 910. Pressurized fluid is introduced into the chamber 910 through one or both of the injector caps 921, 922. The increase in pressure compresses or conforms the tubular sleeve 901 against the collapsible core 935, thereby forming the centralizer 940 shown in FIG. 12. Thereafter, the retainer 932 is removed, and the mandrel 931 is pulled out of the collapsible core 935. After the support provided by the mandrel 931 is removed, at least one of the core sections 935*a* collapses from the core 935, thereby allowing all of the core sections to be removed from the interior of the newly formed centralizer 940. In one embodiment, the ends of the centralizer 940 may be trimmed or removed such that it may resemble the centralizer 950 shown in FIGS. 9A and 9B.

Figure 9A:
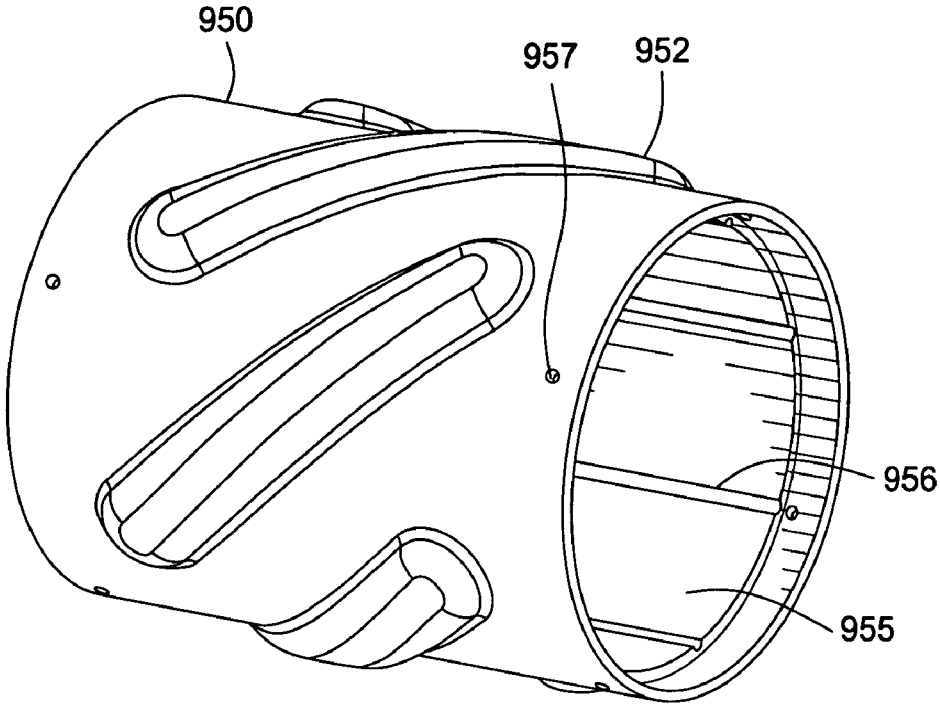
FIGS. 9A-B show another embodiment of a centralizer.
Figure 9B:
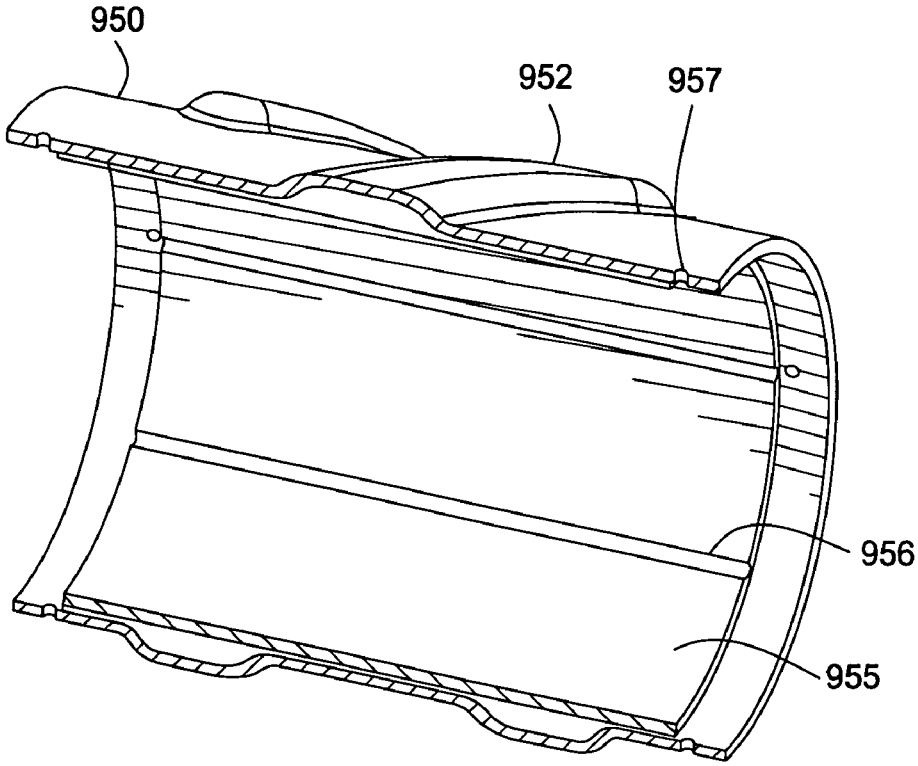

FIGS. 9A-B show an embodiment of a centralizer 950 having a different contact member profile 952 than the centralizer 940 of FIG. 12. In FIG. 9B, it can be seen that the profile 952 is integral to the centralizer 950. In another embodiment, a liner 955 may be disposed inside the centralizer 950. Optionally, one or more flutes 956 may be formed on the liner 955.

Figure 15:
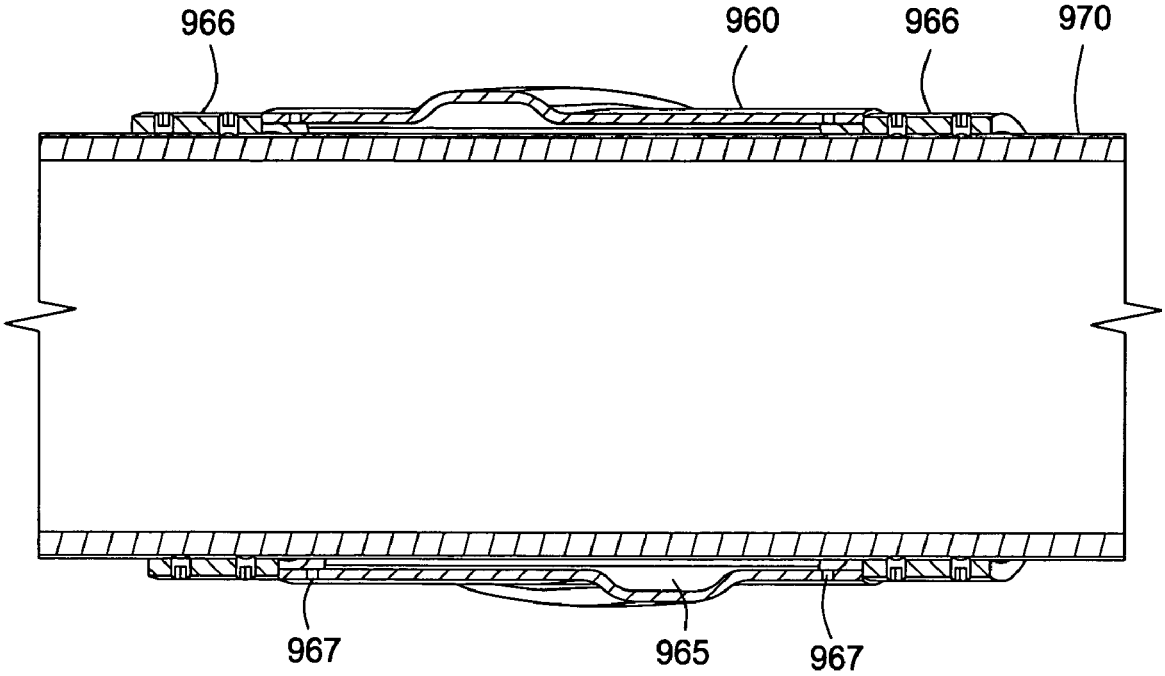
FIGS. 15 and 16 show another embodiment of a centralizer.
Figure 16:
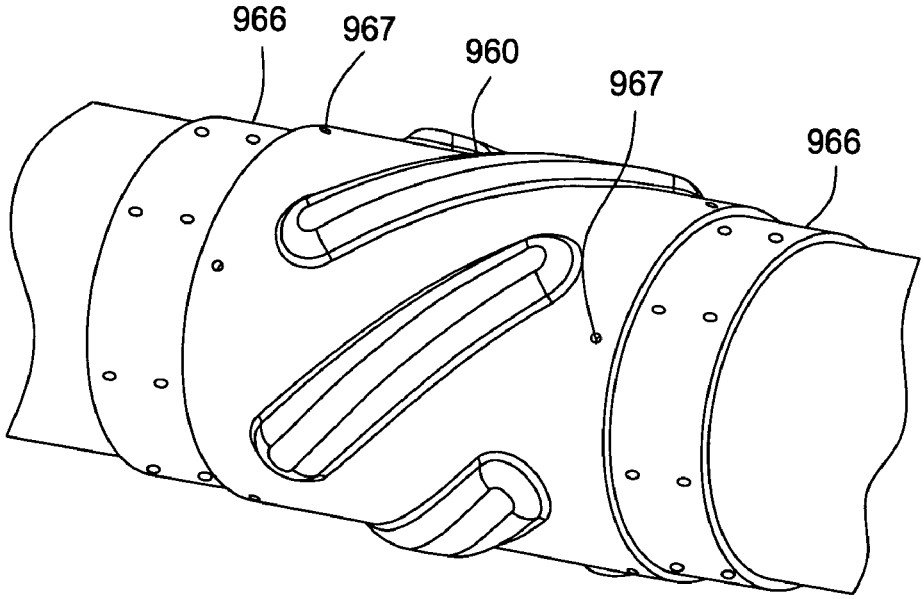

FIGS. 15 and 16 show another embodiment of a centralizer 960. From the cross-sectional view of FIG. 15, it can be seen that the centralizer 960 is manufactured from a hydro-forming process. Also, a liner 965 is disposed on the centralizer 960 to reduce the friction between the centralizer 960 and the casing 970. The centralizer 960 is retained on the casing 970 using to stop collars 966. In one embodiment, one or more vent holes 967 are formed in the centralizer 960. The vent holes 967 facilitate the operation of the centralizer 960 by discharging the debris trapped in the liner flutes. In FIGS. 9A-B, vent holes 957 are also formed in the centralizer 950. In this embodiment, the vent holes 957 are positioned adjacent the flutes 956 of the liner 955.

Although embodiments of the present invention are described for use with a casing, aspects of the present invention may be equally applicable to other types of tubulars such as drill pipe.

While the foregoing is directed to embodiments of the present invention, other and further embodiments of the invention may be devised without departing from the basic scope thereof, and the scope thereof is determined by the claims that follow.

We claim:

1. A method of forming a centralizer, comprising:

providing an apparatus having:

a housing;

a pressure chamber; and a collapsible core disposable in the pressure chamber, the collapsible core having a profile for the centralizer;

placing a tubular sleeve over the collapsible core;

increasing a pressure in the pressure chamber;

conforming the tubular sleeve to the profile of the collapsible core, thereby forming the centralizer; and collapsing the collapsible core.

2. The method of claim 1, further including placing a liner adjacent an interior surface of the centralizer.

3. The method of claim 2, wherein the liner includes a flute formed on a surface of the liner.

4. The method of claim 3, further including forming a vent hole in the centralizer.

5. The method of claim 4, wherein the vent hole formed in the centralizer such that the vent hole is positioned adjacent the flute in the liner.

6. The method of claim 1, further comprising disposing a coating on the centralizer.

7. A method of forming a centralizer, comprising:

providing an apparatus comprising a pressure chamber housing and a collapsible core having at least one profile;

placing a tubular sleeve over the collapsible core and placing the sleeve and the collapsible core in the pressure chamber housing; and increasing the pressure in the pressure chamber housing to compress the tubular sleeve against the collapsible core, thereby forming the centralizer.

8. The method of claim 7, further including collapsing the collapsible core to remove the collapsible core from the centralizer.

9. The method of claim 7, further including forming a vent hole in the centralizer.

10. The method of claim 9, further including placing a liner adjacent an interior surface of the centralizer.

11. The method of claim 9, wherein the liner is placed in the centralizer such that the vent hole is positioned adjacent a flute in the liner.

12. The method of claim 7, wherein the collapsible core comprises at least two core sections.

13. The method of claim 7, wherein the at least one profile has a helix angle relative to an axis of the collapsible core.

14. The method of claim 7, wherein the pressure is increased by introducing a pressurized fluid into the pressure chamber housing.

* * * * *